US010648194B2

(12) United States Patent
Lo

(10) Patent No.: US 10,648,194 B2
(45) Date of Patent: May 12, 2020

(54) FENCE STRUCTURE

(71) Applicant: Chong-Yi Lo, Tainan (TW)

(72) Inventor: Chong-Yi Lo, Tainan (TW)

( * ) Notice: Subject to any disclaimer, the term of this patent is extended or adjusted under 35 U.S.C. 154(b) by 370 days.

(21) Appl. No.: 15/808,938

(22) Filed: Nov. 10, 2017

(65) Prior Publication Data

US 2019/0145123 A1 May 16, 2019

(51) Int. Cl.
*E04H 17/14* (2006.01)

(52) U.S. Cl.
CPC ..... *E04H 17/1443* (2013.01); *E04H 17/1439* (2013.01); *E04H 2017/1495* (2013.01)

(58) Field of Classification Search
CPC . E04H 17/14; E04H 17/1421; E04H 17/1426; E04H 17/1439; E04H 17/1443; E04H 17/1478; E04H 17/16
See application file for complete search history.

(56) References Cited

U.S. PATENT DOCUMENTS 4,014,520 A * 3/1977 Walters ..... E04F 11/181 256/22
5,454,548 A * 10/1995 Moore ..... E04H 17/1443 256/22
6,375,166 B1 * 4/2002 Schall ..... E04H 17/1439 256/21
6,752,386 B1 * 6/2004 Bundy ..... E04H 17/1439 256/22
7,152,849 B2 * 12/2006 Graber ..... E04H 17/1443 256/22
7,384,025 B2 * 6/2008 Lo ..... E04H 17/1439 256/65.08
7,635,115 B2 * 12/2009 Lehmann ..... E04H 17/1443 256/19
8,356,801 B2 * 1/2013 Howard ..... E04H 17/1439 256/21
8,413,332 B2 * 4/2013 Duffy ..... E04H 17/1439 29/897.31
8,695,949 B2 * 4/2014 Stinson ..... E04H 17/143 256/64
9,027,909 B1 * 5/2015 Peyton ..... E04H 17/1439 256/67
9,404,283 B1 8/2016 Lo
2013/0264532 A1 * 10/2013 Goodman ..... E04H 17/1439 256/65.08
2015/0252588 A1 * 9/2015 Springborn ..... B23P 19/02 256/65.05

* cited by examiner

*Primary Examiner* — Daniel J Wiley
(74) *Attorney, Agent, or Firm* — Alan D. Kamrath; Karin L. Williams; Mayer & Williams PC

(57) ABSTRACT

A fence structure has a plane extended from the top of a connecting board to a vertical pipe and an embedded opening formed at corresponding position for embedding the vertical pipe. A protective flange is protruded from each of two corresponding sides of the embedded opening, attached onto a horizontal pipe for passing the vertical pipe to an inner wall of a hole, and installed at a position in the same displacing direction when the angle of the vertical pipe is adjusted. The horizontal pipe is formed by a main body with an opening on the longitudinal side and a cover disposed at the opening position and coupled to the main body. While adjusting the angle of the fence, the vertical and horizontal pipes are prevented from hitting each other or scratching their outer surfaces. In addition, the time and labor of assembling the fence can be reduced.

4 Claims, 11 Drawing Sheets

(A-A)

FENCE STRUCTURE

BACKGROUND OF THE INVENTION

Field of the Invention

The present invention relates to a fence structure, and more particularly to a fence featuring a convenient assembling process, saving time and labor, and preventing the outer surface of vertical and horizontal pipes from being scratched when the vertical and horizontal pipes touch or hit each other in the process of adjusting the angle of the fence.

Description of the Related Art

As disclosed in U.S. Pat. No. 7,384,025 (hereinafter referred to as "D1") issued to the inventor of the present invention, a horizontal pipe and a vertical pipe are connected with each other by a screw hidden device, and the D1 is characterized in that a positioning strip is installed in the horizontal pipe, and each horizontal pipe hides each screw and each positioning strip to beautify the appearance of the fence structure. In another U.S. Pat. No. 9,404,283 (hereinafter referred to as "D2") entitled "Fence structure" and issued to the inventor of the present invention, the fence structure of the D2 comprises a plurality of horizontal pipes 13 and a plurality of vertical pipes 10 intersected with each other, and a plurality of horizontal connecting boards 11 horizontally disposed on a side of the vertical pipes 10 and also on the inner side of the horizontal pipes 13 for supporting the horizontal pipe 13 on the vertical pipe 10.

However, the application of D1 and D2 still has the following drawbacks and requires further improvements.

1. Since there is a notch at the bottom of the horizontal pipe, the peripheral surface of the horizontal pipe is incomplete.

2. When the fence is assembled, it is necessary to assemble the vertical pipes with the horizontal pipes one by one with a space apart from each other and to insert the vertical pipes into the corresponding holes respectively, so that the assembling process takes much time and effort.

3. When the angle of installing the fence is adjusted, the intersection angle between the horizontal and vertical pipes is changed. When such angle is adjusted to its limit, the pipe wall of the vertical pipe touches the hole of the horizontal pipe, and the pipe wall of the vertical pipe will touch the hole wall of the hole of the horizontal pipe, and the pipe wall of the vertical pipe will be rubbed to produce a scratch or a paint chip or damage the surface of the vertical pipe.

SUMMARY OF THE INVENTION

Therefore, it is a primary objective of the present invention to provide a fence structure capable of maintaining the integrity of the peripheral surface of the horizontal pipes, reducing the time and labor of the assembling process, and preventing the vertical pipes and horizontal pipes from hitting each other or scratching their outer surfaces when the angle of the pipes is adjusted.

To achieve the aforementioned and other objectives, the present invention discloses a fence structure characterized in that a connecting board is disposed in the horizontal pipe for supporting the horizontal pipe and pivoting the vertical pipes, and a plane is extended from the top of the connecting board towards the vertical pipe, and the plane has an embedded opening configured to be corresponsive to the vertical pipe for embedding the vertical pipe. A protective flange is protruded from each of two corresponding sides of the embedded opening and attached onto the horizontal pipe for passing the vertical pipe through an inner wall of a hole, and the protective flange is installed at a position in the same direction as the displacing direction of the vertical pipe when the angle of the vertical pipe is adjusted. The protective flange is provided, and the connecting board is made of a protective material (such as plastic), so that when the angle of the vertical pipe (or horizontal pipe) is adjusted, the inner wall of the hole is limited and protected and will not be in contact with the vertical pipe outer wall, so as to prevent the pipe wall of the vertical pipe from hitting the wall of the hole of the horizontal pipe or scratching the surface of the vertical pipe.

The present invention is also characterized in that the horizontal pipe is comprised of a main body having an opening on a longitudinal side and a cover disposed at the position of the opening and coupled to the main body. Both of the top and bottom of the main body have a plurality of corresponding holes (upper holes and lower holes), and the holes have an open opening formed at an end facing the opening, so that when the horizontal pipes and the vertical pipes are assembled, the vertical pipes are embedded into the hole of the main body through the hole opening, and then the cover is combined with the main body. The invention improves the conventional fence that passes the vertical pipes into the holes of the horizontal pipes one by one respectively and reduces the time and labor of assembling the fence.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
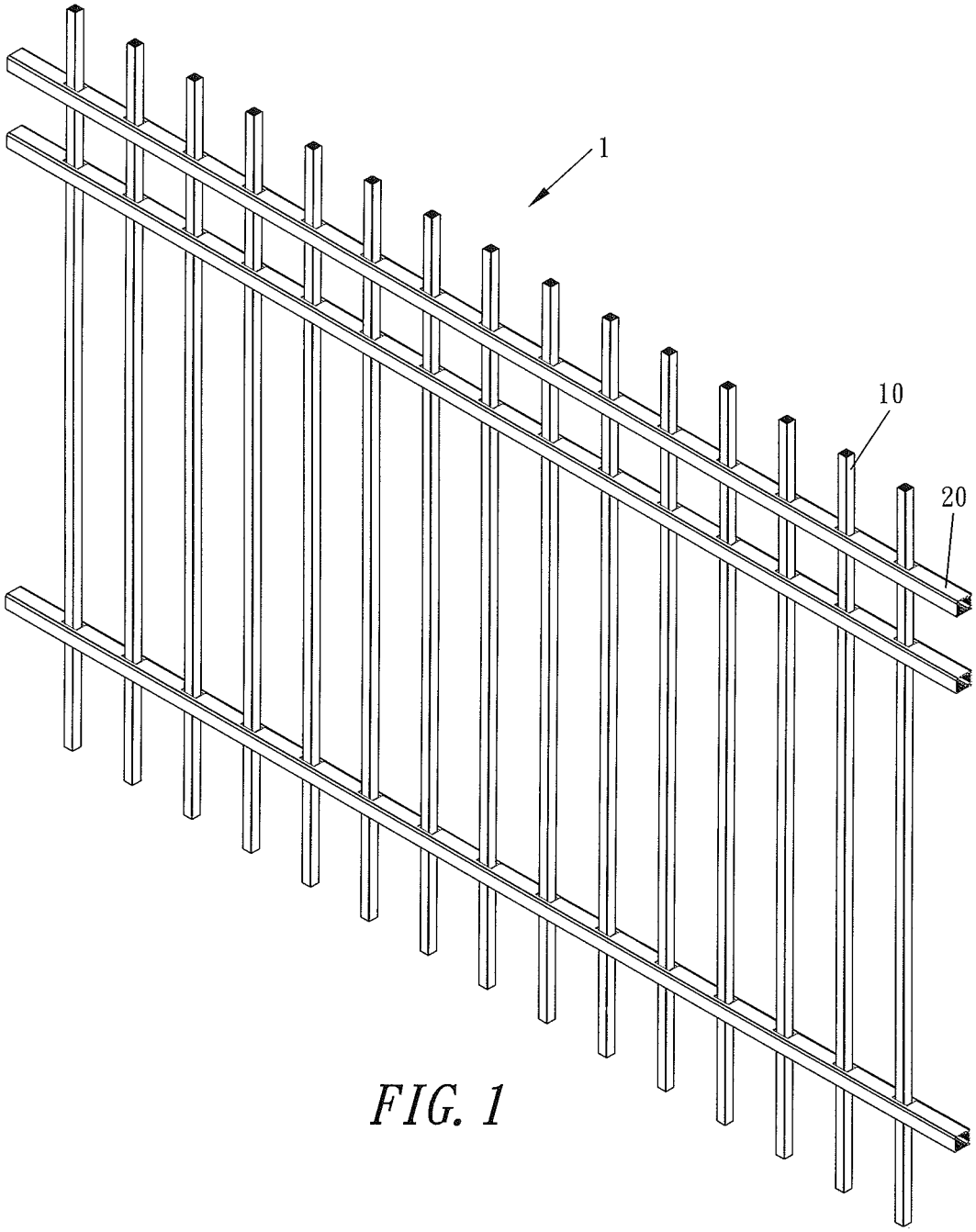
FIG. 1 is a perspective view of vertical pipes in accordance with a preferred embodiment of the present invention.
Figure 2:
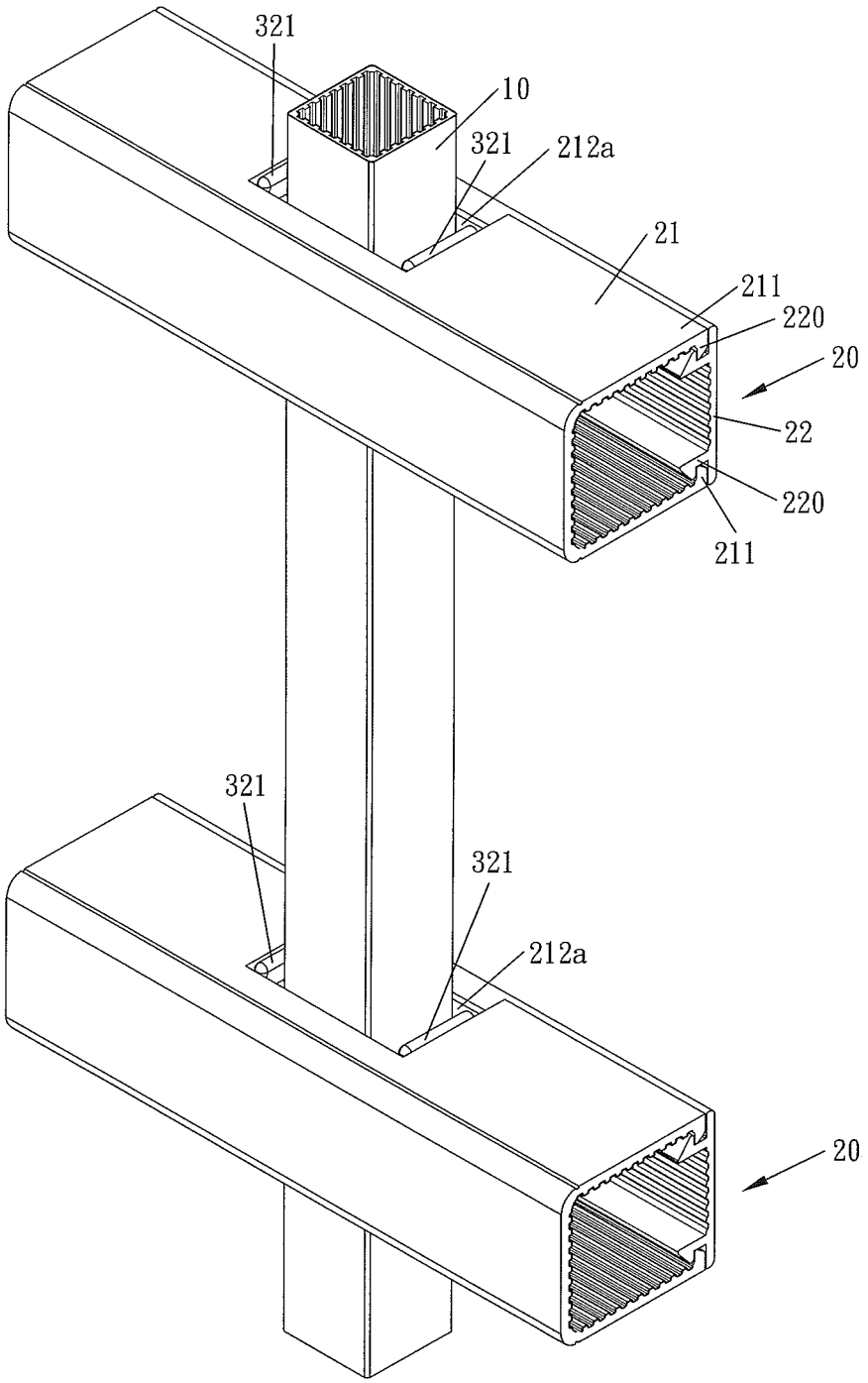
FIG. 2 is a partial blowup view of FIG. 1.
Figure 3:
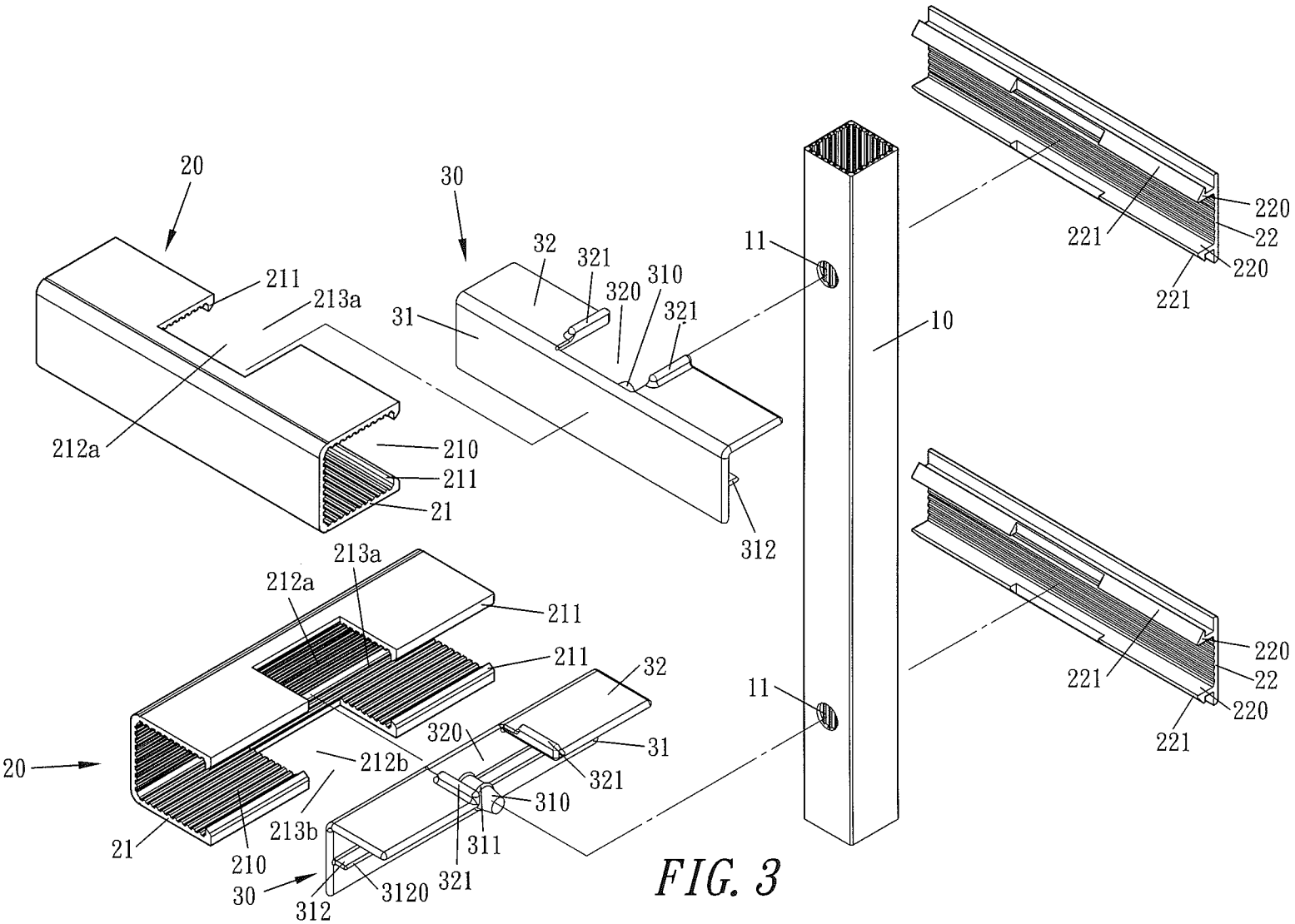
FIG. 3 is an exploded view of FIG. 1.

With reference to FIGS. 1~3 for a fence of the present invention, the fence 1 comprises a plurality of vertical pipes 10, a plurality of horizontal pipes 20 and plurality of connecting members 30. Wherein, the vertical pipes 10 and the horizontal pipes 20 are passed and intersected with each other; the connecting members 30 are disposed in the horizontal pipe 20 and pivoted with an outer wall of the vertical pipe 10 to provide the effect of supporting and fixing the horizontal pipe 20 and prevent the horizontal pipe 20 from sliding away from the predetermined installation position.

Wherein, the vertical pipe 10 is in a tubular shape, and the pipe wall of each of the horizontal pipes 20 has a radial pivot hole 11 at the intersection position.

The horizontal pipe 20 is comprised of a main body 21 and a cover 22. The main body 21 is hollow and has an opening 210 formed on a longitudinal side, and a blocking flange 211 configured to be corresponsive to the upper and lower opening edges of the opening 210 and extended towards the interior of the opening 210. Both of the top and bottom of the main body 21 have an upper hole 212*a* and a lower hole 212*b* formed thereon and configured to be corresponsive to the installation positions of each vertical pipe 10 respectively, and the upper and lower holes 212*a*, 212*b* are aligned precisely in the vertically up-and-down direction, and have a hole opening 213*a*, 213*b* facing an end of the opening 210. The cover 22 is installed at a position of the opening 210 of the main body 21 and provided for covering the opening 210; each of the upper and lower ends of the cover 22 has a hook 220 extending into the opening 210, and the extending end of the hook 220 has an inclined guiding side 221, so that when the cover 22 and the main body 21 are combined, the guiding side 221 is provided for sliding the blocking flange 211, so that the hook 220 can be latched and positioned with the blocking flange 211 accordingly to cover the opening 210. The blocking flange 211 and the hook 220 constitute a binding device for combining the main body 21 and the cover 22 to form a horizontal pipe 20.

Figure 4:
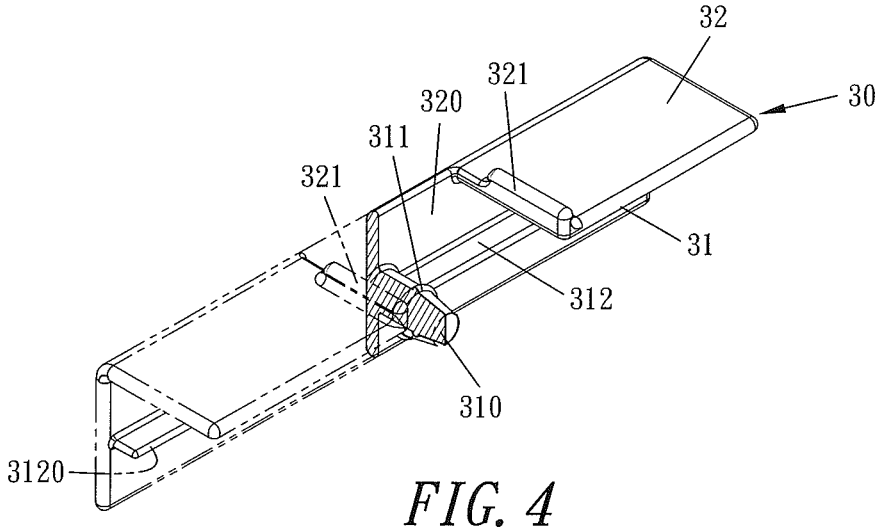
FIG. 4 is a schematic view of a connecting board in accordance with a preferred embodiment of the present invention.
Figure 5:
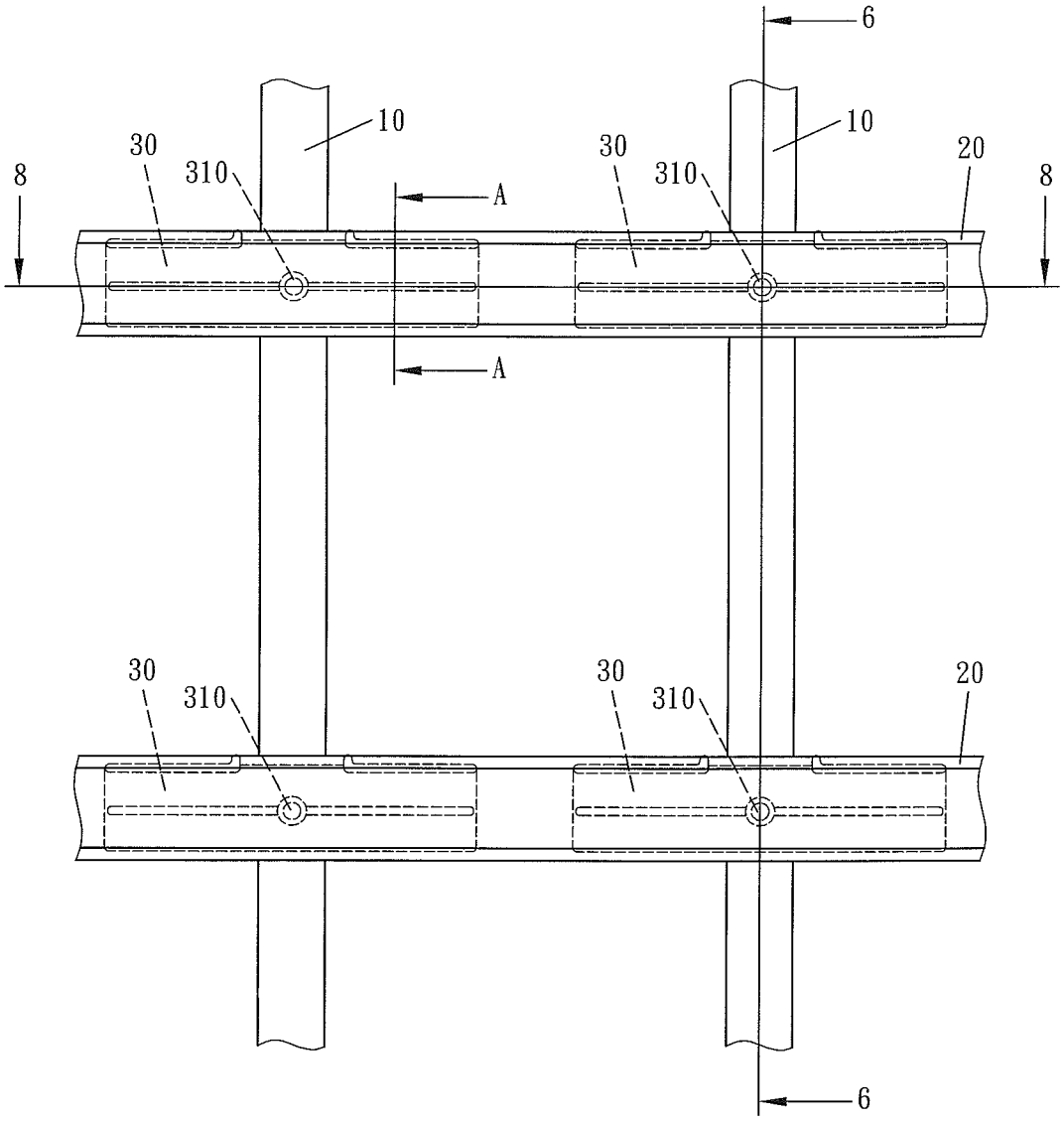
FIG. 5 is a front view of a portion of a fence in accordance with a preferred embodiment of the present invention.
Figure 6:
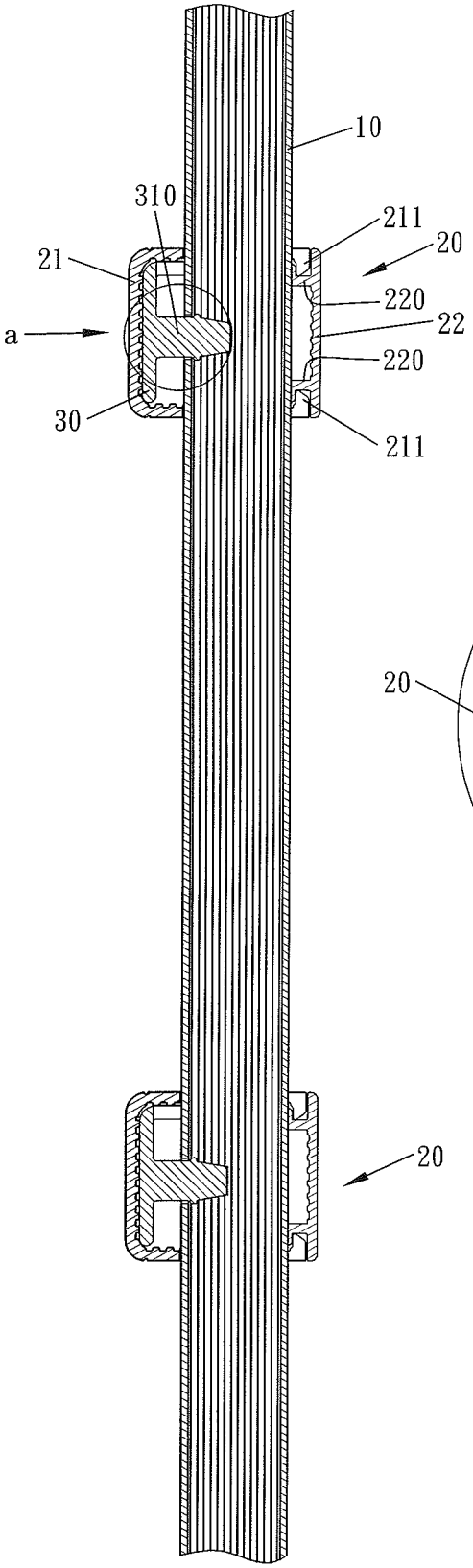
FIG. 6 is a cross-sectional view of Section 6-6 of FIG. 6.
Figure 7:
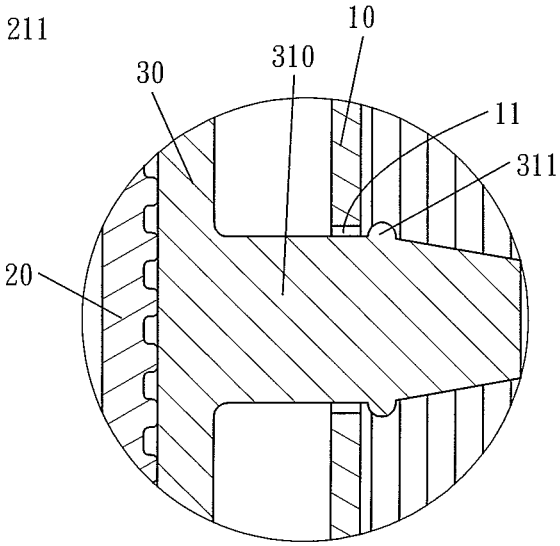
FIG. 7 is a partial blowup view of FIG. 6.
Figure 8:
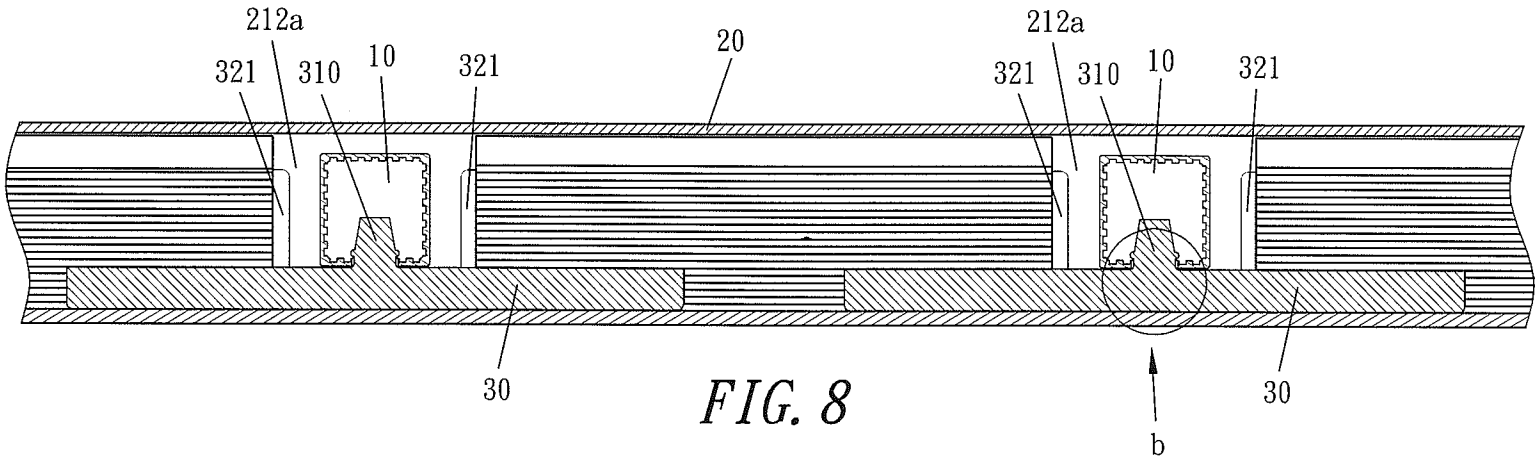
FIG. 8 is a cross-sectional view of Section 8-8 of FIG. 5.
Figure 9:
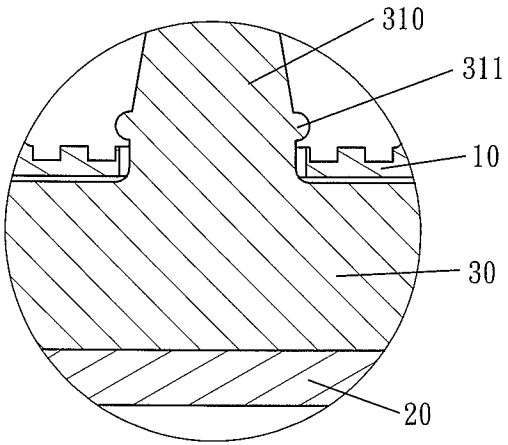
FIG. 9 is a blowup view of Section b of FIG. 8.
Figure 10:
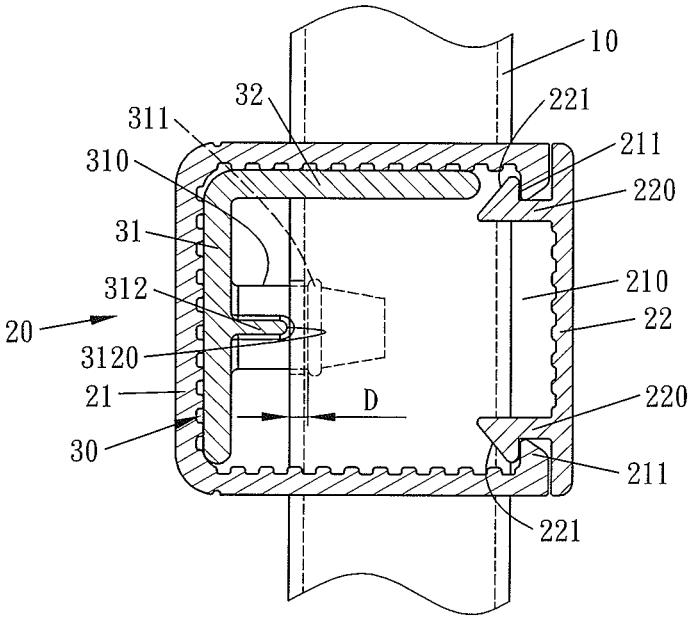
FIG. 10 is a cross-sectional view of Section A-A of FIG. 5.

The connecting board 30 is inverted L-shaped and has a straight side 31 and a plane 32 horizontally extended from the top of the straight side 31. An abdominal portion of the straight side 31 has a pivot shaft 310 horizontally extending towards the bottom of the plane 32 (as shown in FIGS. 4 and 10), and a positioning ring 311 is protruded from a middle section of the pivot shaft 310, and the connecting board 30 has a clip wall 312 horizontally extended from the abdominal portion of the straight side 31 towards the bottom of the plane 32, and a horizontal gap D is formed between an extending end 3120 of the clip wall 312 and the positioning ring 311 (as shown in FIG. 10), and the horizontal gap D has a size equal to the unilateral thickness of the vertical pipe 10, so that after the pivot shaft 310 and the positioning ring 311 are passed into the pivot hole 11, the extending end 3120 of the clip wall 312 and the positioning ring 311 can attach and fix the outer wall on a side of the vertical pipe 10 to the inner wall, so as to pivot the connecting board 30 to an outer wall of the vertical pipe 10. The plane 32 has an embedded opening 320 formed at a position corresponsive to the position of the upper and lower holes 212*a*, 212*b*, and the embedded opening 320 has an open opening facing an end of the vertical pipe 10, and a protective flange 321 is protruded from each of two corresponding sides. After the connecting board 30 and the horizontal pipe 20 are combined, the protective flange 321 is attached to the interior of the upper hole 212 of the horizontal pipe 20 and also attached to the hole wall of the upper hole 212, and the protective flange 321 is installed at a position in the same direction as the displacing direction of the vertical pipe 10 when the angle of the vertical pipe 10 is adjusted. With the protective flange 321 and the connecting board 30 made of a protective material (such as plastic) for preventing the metal pipes from being scratched, so that when the angle of the vertical pipe 10 (or horizontal pipe 20) is adjusted, the inner wall of the upper hole 212 will be protected and limited by the protective flange 321, and the outer wall of the vertical pipe 10 will not be rubbed, so as to prevent the vertical pipes and horizontal pipes 10, 20 from hitting each other or scratching the surface of the pipes.

With reference to FIGS. 5~10 for the process of assembling the fence 1, the assembling process comprises the following steps:

Step 1: Embed a connecting board 30 into the respective position of the upper and lower holes 212*a*, 212*b* of the main body 21 of each horizontal pipe 20, so that the protective flange 321 of the connecting board 30 is situated in the upper hole 212*a* and attached onto a hole wall of the upper hole 212*a*.

Step 2. Embed a vertical pipe 10 into the respective position of the upper and lower holes 212*a*, 212*b* of the main body 21 (as formed after Step 1), and the pivot shaft 310 of the connecting board 30 into the respective pivot hole 11 of the vertical pipe 10, and then slide the connecting board 30 through the blocking flange 211 by the guiding side 221 of the hook 220 of the binding device, so that the hook 220 is latched and fixed to the blocking flange 211 accordingly to cover the opening 210 of the main body 21 and maintain the integrity of the peripheral pipe wall of the horizontal pipe 20.

Figure 11:
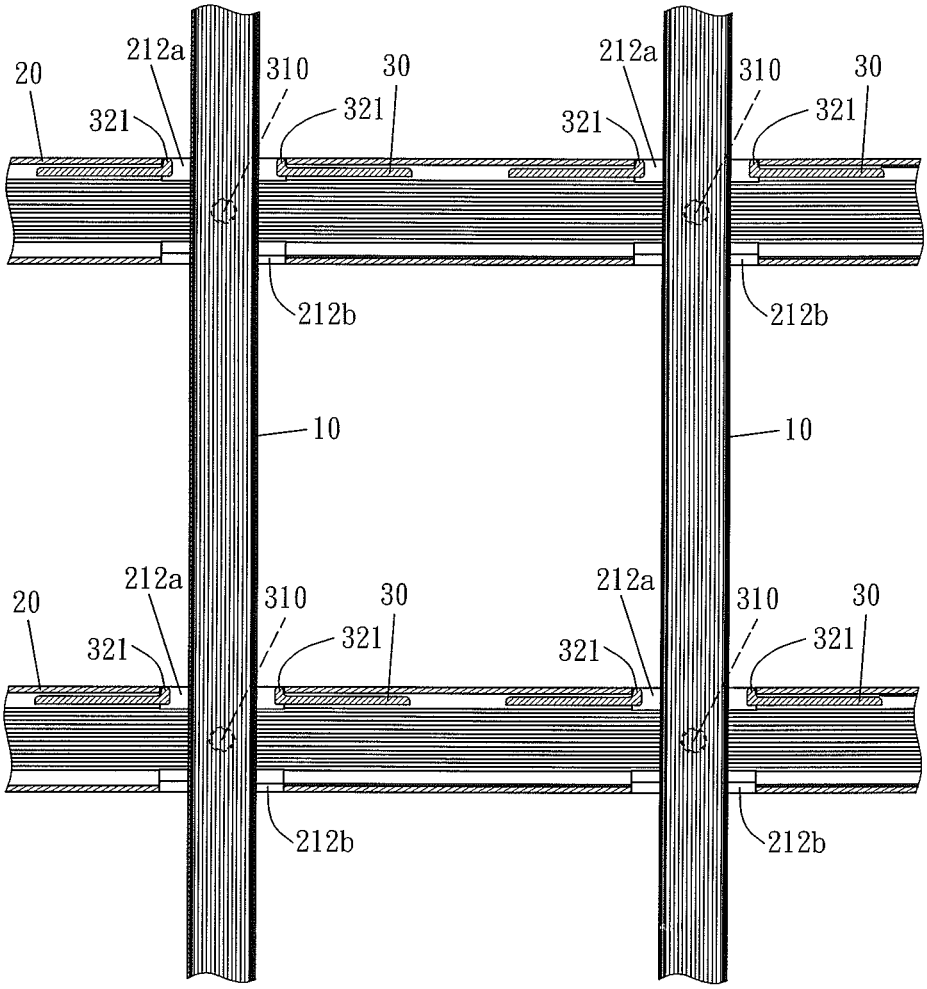
FIG. 11 is a cross-sectional view of FIG. 5 (when the angle of the pipes of the fence has not been adjusted)
Figure 12:
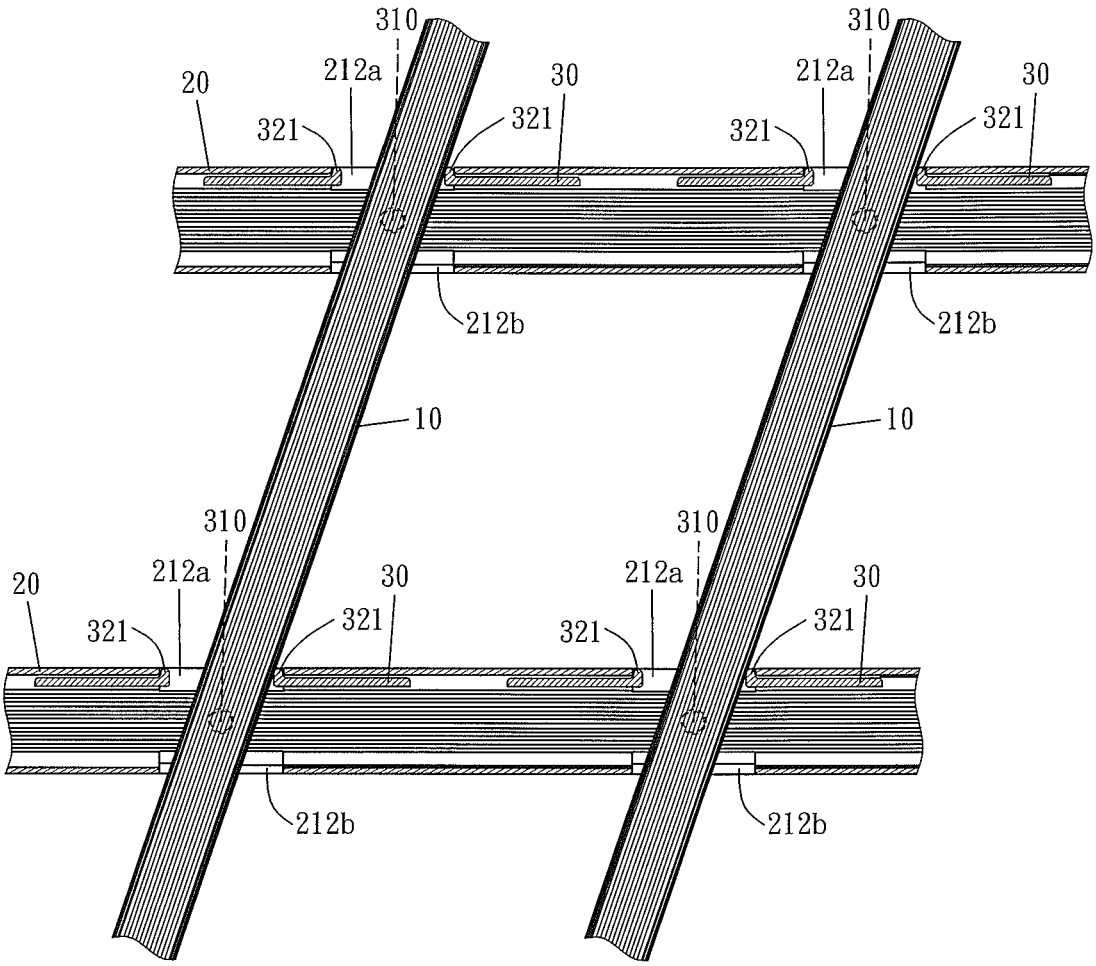
FIG. 12 is a schematic view of a vertical pipe which is adjusted towards the right side in accordance with a preferred embodiment of the present invention.
Figure 13:
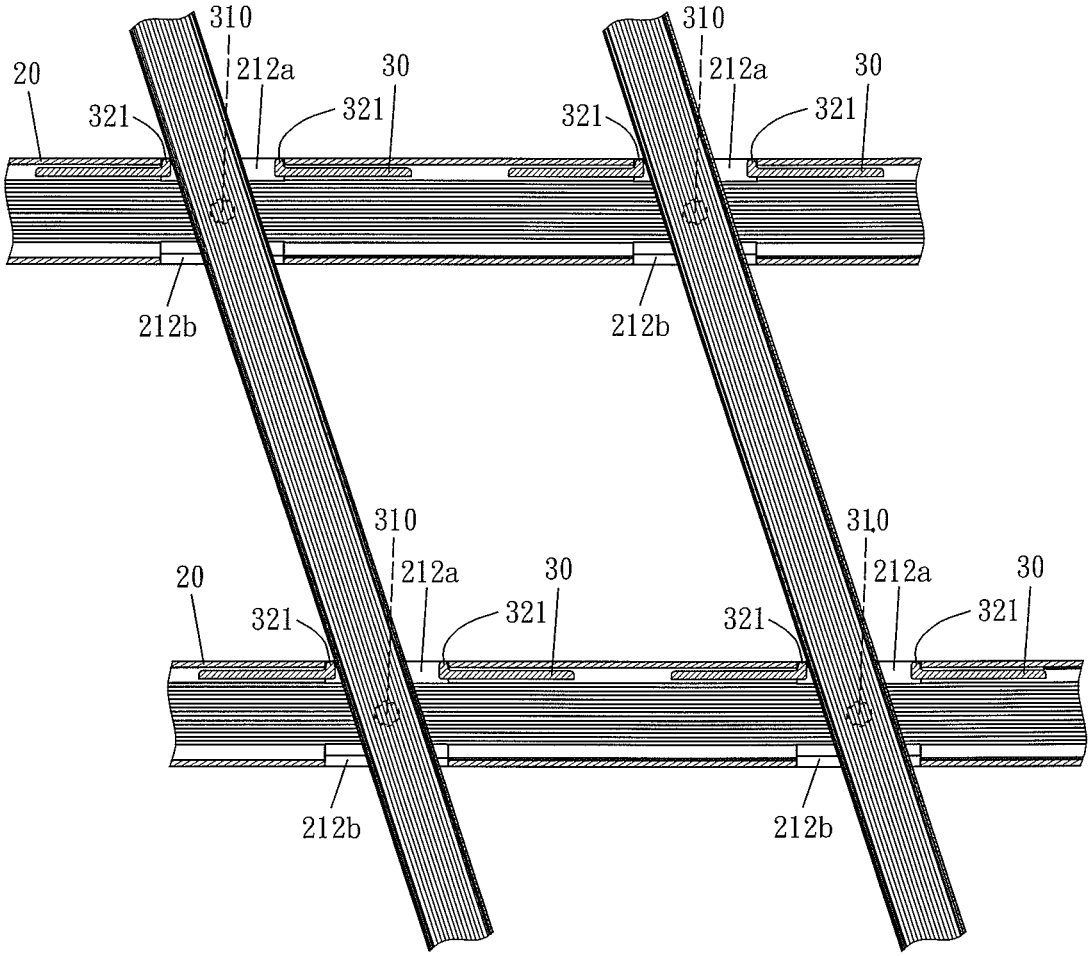
FIG. 13 is a schematic view of a vertical pipe which is adjusted towards the left side in accordance with a preferred embodiment of the present invention.

In FIGS. 11~13, when the angle of the pipes of the fence 1 is adjusted, the vertical pipe 10 may be adjusted by shifting the axis to the left or right by the pivot shaft 310. Regardless of the vertical pipe 10 shifting all the way to the right (as shown in FIG. 12), or all the way to the left (as shown in FIG. 13), the vertical pipe 10 will be limited and protected by the protective flange 321, so that the outer wall of the vertical pipe 10 will not rub with the hole wall of the upper and lower holes 212*a*, 212*b* of the horizontal pipe 20 to prevent the pipe wall of the vertical pipe 10 from being scratched.

In summation, the present invention has the following advantages and effects:

1. The time and labor for assembling the fence 1 are reduced.
2. When the angle of the pipes of the fence 1 is adjusted, the pipe wall of the vertical pipe 10 and the hole wall of the horizontal pipe 20 can be prevented from being scratched.
3. The integrity of the peripheral wall of the horizontal pipe 20 can be maintained.

In summation of the above description, the present invention herein enhances the performance than the conventional structure and further complies with the patent application requirements and is submitted for patent application. While the invention has been described by means of specific embodiments, numerous modifications and variations could be made thereto by those skilled in the art without departing from the scope and spirit of the invention set forth in the claims.

What is claimed is:

1. A fence structure, comprising:

a plurality of vertical pipes;

a plurality of horizontal pipes; and a plurality of connecting members, wherein the vertical pipes and the horizontal pipes intersect with each other;

wherein each connecting member is installed inside one of the horizontal pipes and pivoted with respect to an outer pipe wall of one of the vertical pipes, and the vertical pipe has a radial pivot hole formed on the outer pipe wall at an intersected position of the horizontal pipe;

wherein each of the horizontal pipes comprises a main body and a cover;

wherein the main body is hollow and has an opening formed on a longitudinal side;

wherein the top and bottom of the main body have an upper hole and a lower hole, respectively, configured to receive a vertical pipe, and the upper and lower holes are aligned vertically, and an open hole is formed towards an end of the opening;

wherein the cover is installed at an opening position of the main body by a binding device on the cover;

wherein each connecting member comprises a straight side and a plane horizontally extended from the top of the straight side with an abdominal portion of the straight side having a pivot shaft horizontally extending towards the bottom of the plane, and the pivot shaft being extended into the radial pivot hole, the plane having an embedded opening formed at a position corresponsive to the upper and lower holes, and the embedded opening having an open opening facing an end of the vertical pipe, and a protective flange being extended from opening edges on two corresponding sides of the open opening, wherein the protective flange is attached to an interior of the upper hole of the horizontal pipe and also attached to a hole wall of the upper hole, and the protective flange is installed in in a displacing direction of the vertical pipe while adjusting the angle of the vertical pipe.

2. The fence structure of claim 1, wherein the binding device is comprised of a blocking flange and a hook, and the blocking flange is disposed at the position of the upper and lower opening edges of the opening of the main body and extended towards the interior of the opening; and the hook is formed by extending upper and lower ends of the cover towards the interior of the opening, and an extending end of the hook has an inclined guiding side.

3. The fence structure of claim 1, wherein the pivot shaft has a positioning ring protruded from a middle section of the pivot shaft; a clip wall horizontally extended from the abdominal portion of the straight side to the bottom of the plane, and a horizontal gap is formed between an extending end of the clip wall and the positioning ring, and the horizontal gap has a size equal to a unilateral thickness of the vertical pipe.

4. The fence structure of claim 1, wherein the connecting members and the protective flanges are made of a protective material for preventing the pipes from being scratched.

* * * * *